United States Patent [19]

Werth et al.

[11] 4,387,943

[45] Jun. 14, 1983

[54] ELECTRICAL CONNECTOR HAVING FRONT OR REAR RELEASABLE AND REMOVABLE CONTACTS

[75] Inventors: Dee A. Werth, Nineveh; Alan L. Schildkraut, Sidney; David W. MacAvoy, Bainbridge, all of N.Y.

[73] Assignee: The Bendix Corporation, Southfield, Mich.

[21] Appl. No.: 279,143

[22] Filed: Jun. 30, 1981

[51] Int. Cl.[3] ..... H01R 13/42

[52] U.S. Cl. ..... 339/59 R

[58] Field of Search ..... 29/747-761; 339/59 R, 59 M, 217 S

[56] References Cited

U.S. PATENT DOCUMENTS

| | | | |
|---|---|---|---|
| 3,158,424 | 11/1964 | Bowen . | |
| 3,165,369 | 1/1965 | Maston . | |
| 3,221,292 | 11/1965 | Swanson et al. . | |
| 3,390,376 | 6/1968 | Nava | 339/217 S X |
| 3,747,047 | 7/1973 | Carter et al. | 339/217 S X |
| 3,808,578 | 4/1974 | Hansen | 339/59 M |
| 3,824,681 | 7/1974 | Clark | 339/90 C |
| 4,082,398 | 4/1978 | Bourdon et al. | 339/59 M |

FOREIGN PATENT DOCUMENTS

| | | | |
|---|---|---|---|
| 1490553 | 1/1970 | Fed. Rep. of Germany | 339/217 S |

*Primary Examiner*—Mark Rosenbaum

*Attorney, Agent, or Firm*—Raymond J. Eifler

[57] ABSTRACT

The invention is an electrical connector assembly of the type having a housing (50); a rubber moisture sealing grommet (70) and a contact retaining insert assembly (10 and 20) characterized by a rear insert (10) having a plurality of passages (15) that contain resiliently and radially deflectable members (11) that include at the forward ends thereof a radially inwardly chamfered surface (13) and, rearwardly adjacent to the chamfered surface (13), a forwardly facing shoulder (12) to engage the rearwardly facing shoulder (31) of a contact (30) located in a passage; and a plurality of passages (22) and a front insert (20) each communicating with a respective forwardly facing shoulder (12) of the deflectable members (11) to enable a tool to be inserted into either the front passages (22) or rear passage (15) to engage and radially deflect the members (11) to release the contact (30) for removal from the rear of the connector.

3 Claims, 7 Drawing Figures

ELECTRICAL CONNECTOR HAVING FRONT OR REAR RELEASABLE AND REMOVABLE CONTACTS

This invention relates to electrical connectors having removable contacts and more particularly to the contact retaining mechanism within the connector.

Electrical connectors generally include a plug and a receptacle, each of which has an insert of dielectric material provided with multiple openings within which electrical contacts are releasably retained. Examples of electrical connectors that have rear releasable and rear removable contacts may be found in U.S. Pat. Nos. 3,165,369 issued Jan. 12, 1965 and entitled, "Retention System for Electrical Contacts;" 3,158,424 issued Nov. 24, 1964 and entitled, "Contact Mounting;" and 3,824,681 issued July 23, 1974 and entitled, "Method of Providing a Coupling for Electrical Connectors and the Like." Connectors of this type allow contacts to be removed from the rear of a connector while it is still connected to another connector. An example of another type of electrical connector that has front releasable and front removable contacts as well as rear releasable and rear removable contacts may be found in U.S. Pat. No. 4,082,398 issued Apr. 4, 1978 and entitled, "Electrical Connector with Front and Rear Insertable and Removable Contacts." Finally, an example of an electrical connector of the type having front releasable and rear removable contacts may be found in U.S. Pat. No. 3,221,292 issued Nov. 30, 1960 and entitled "Electrical Connector." This last type of connector makes it easier to identify the contact to be removed since identification of the contact is located in the front face of the connector.

None of the foregoing connectors provide a connector that permits front or rear release of a contact that can be removed from the rear of the connector.

DISCLOSURE OF THE INVENTION

This invention provides an electrical connector having front or rear releasable and rear insertable and removable contacts.

The invention is an electrical connector characterized by a rear insert having a plurality of passages that contain resiliently and radially deflectable members that include at the forward ends of said members a radially inwardly chamfered surface and, rearwardly adjacent to the chamfered surface a forwardly facing shoulder to engage the rearwardly facing shoulder of a contact located in a passage and a plurality of passages in a front insert each communicating with a respective forwardly facing shoulder of the deflectable members to enable an appropriate tool to be inserted into either the front or rear passages to engage and radially deflect the members to release the contact for removal from the rear of the connector.

One advantage of this invention is that it provides the option of releasing a contact from either the front or the rear of a connector depending on the circumstances involved with removing the contact from the rear of the connector.

Another advantage of the invention is that it provides a connector that combines the advantages of a front release and a rear release connector into one connector having rear removable contacts.

DETAILED DESCRIPTION OF THE INVENTION

FIG. 1 illustrates the contact retaining members of the connector insert.

FIGS. 2, 3, and 4 illustrate how a contact is released for removal from the contact retaining insert.

Figure 1:
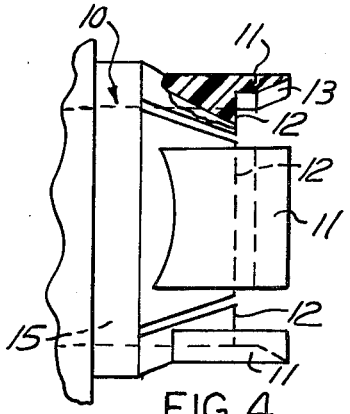

Referring now to the drawing, FIG. 1 illustrates a plurality of resiliently and radially deflectable members 11 that are adapted to retain a contact (not shown) within an electrical connector.

The contact retaining insert 10 shows only one bore 15 of a plurality of bores 15 that would be located in the insert 10. At the end of each of the bores 15 there are preferably four retention members 11 that are generally arranged in the shape of a truncated cone. Each contact retention member 11 includes a forwardly facing shoulder 12 and a chamfered surface 13 that extends radially outwardly away from the forwardly facing shoulder 12.

Figure 2:
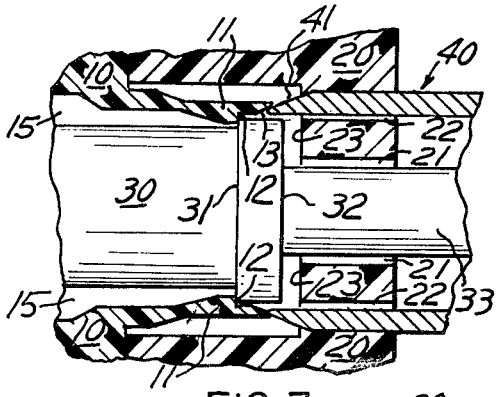

FIG. 2 illustrates a contact 30 retained by a rear insert 10 and a forward insert 20 before it is released by a tool 40. The contact 30 includes an enlarged middle portion that is captivated between shoulder 12 of the rear insert 10 and surface 23 of the forward insert 20. Rearwardly facing shoulder 31 of the contact 30 engages the forwardly facing shoulders 12 of the rear insert 10 deflectable members 11 to prevent rearward movement of the contact 30. Similarly forwardly facing shoulder 32 of the contact 30 and rearwardly facing surface 23 of the forward insert 20 prevents forward movement of the contact 30. When retained, the contact 30 has its rear portion located in the bore 15 of the rear insert 10 and a portion of its forward mating portion 33 located in the bore 21 of the forward insert 20. The forward insert 20 includes a plurality of central passages 21 each surrounded by a second plurality of passages 22 for receiving the tines of a contact removal tool 40 that are adapted to deflect the members 11 to release the contact 30. At the end of each of the tines of the contact removal tool 40 there is a chamfered surface 41 which engages the chamfered surface 13 of the deflectable members 11. Initial engagement of these surfaces is shown in FIG. 2.

Figure 3:
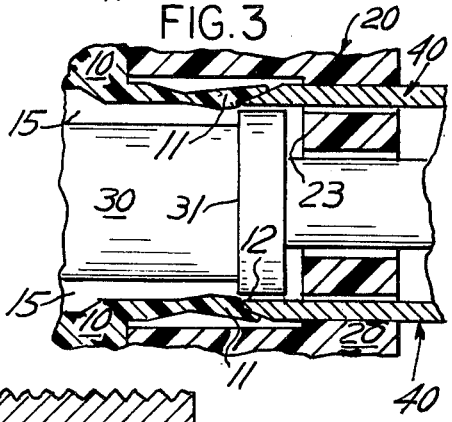

FIG. 3 illustrates a contact removal tool 40 inserted further through passages 22 to deflect members 11 so that the rearwardly facing shoulder 31 of the contact 30 no longer engages the forwardly facing shoulder 12 of the members 11.

Figure 4:
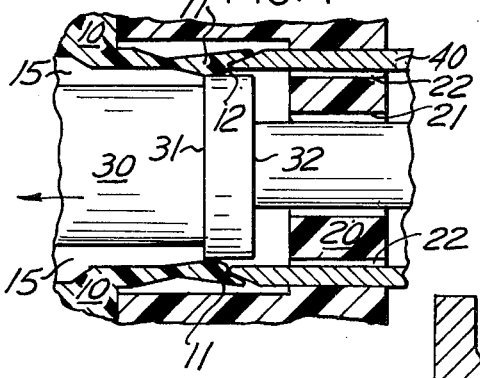

FIG. 4 illustrates partial withdrawal of the contact 30 from the rear of the contact retaining inserts 10 and 20. Since the forwardly facing shoulder 12 of the deflectable members 11 no longer engages the shoulder 31 of the contact 30, the contact 30 may be removed from the rear of insert 10.

Figure 5:
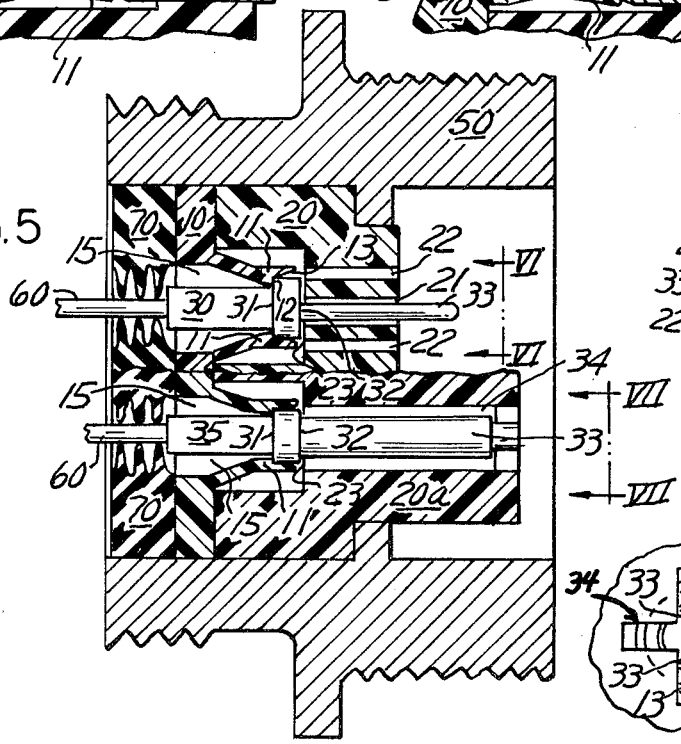
FIG. 5 illustrates an electrical connector incorporating the principles of this invention.

FIG. 5 illustrates an electrical connector incorporating the principles in this invention. The electrical connector includes a tubular shell or housing 50; a rubber moisture sealing grommet 70; a rear and front contact retaining insert 10 and 20, which are preferably bonded together; and pin type contact 30 and socket type contact 35 both releasably retained by the inserts 10, 20 and 20*a*. To release the male contact 30 from the rear of the connector a standard contact removal tool may be inserted through the rubber grommet 70 to deflect the members 11 outwardly thereby disengaging shoulder 12 from shoulder 31. The contact may then be removed from the rear of the connector by pulling on wire 60 attached to the contact 30. An example of a suitable contact removal tool may be found in U.S. Pat. No. 3,110,093 issued Nov. 12, 1963 and entitled "Contact Extraction and Installation Tool." To release the contact 30 from the front of the connector the tines of a contact removal tool are inserted into passages 22 to deflect the members 11 outwardly is shown in FIGS. 3 and 4.

Similarly, removal of the socket type contact 35 may be accomplished in the same manner. The socket type contact 35 is retained by the shoulders 12 of deflectable members 11 that engage the rearwardly facing shoulder 31 on the contact 35 and by the rearwardly facing surface 23 of the forward insert 20*a* which engages the forwardly facing shoulder 32 of the socket type contact 35. Channels 34 provide access to the deflectable members 11.

Figure 6:
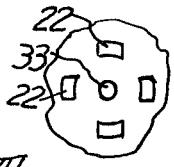
FIG. 6 illustrates a partial view of the front of the pin type contact retaining insert assembly taken along lines VI—VI.

FIG. 6 shows the arrangement of the four passages 22 in insert 20 that communicate with the deflectable fingers 11 of insert 10 to permit the release of a contact retained within inserts 10 and 20.

Figure 7:
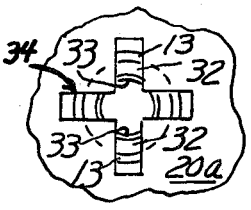
FIG. 7 illustrates a partial view of the socket type contact retaining insert assembly taken along VII—VII.

FIG. 7 is a partial front view of the connector in FIG. 5 illustrating how access is provided through Channels 34 to the chamfered surface 13 of the delfectable members 11.

While a preferred embodiment of the invention has been disclosed it will be apparent to those skilled in the art that changes may be made to the invention as set forth in the appended claims and in some instances certain features of the invention may be used to advantage without corresponding use of other features. For instance, the configuration of the forward insert 20 changes somewhat to 20*a* to accommodate the retention of a socket type contact but both arrangements provide for either front or rear release and rear removal of a contact. Further, although four retention members 11 are preferred, more or less members 11 could be used. Accordingly, it is intended that the illustrative and descriptive materials herein be used to illustrate the principles of the invention and not to limit the scope thereof.

Having described the invention what is claimed is:

1. In combination with an electrical connector having front and rear releasable and rear removable contacts, said connector of the type having: a housing; a plurality of contacts, each contact having a rear portion, a forward mating portion, and an enlarged middle portion having a forwardly facing shoulder and a rearwardly facing shoulder; and means for releasably mounting said contacts in said housing including a rear insert having a plurality of bores each having the rear portion of a respective contact therein, a plurality of resiliently and radially deflectable members extending from the forward portion of each of said bores, and a forward insert having a plurality of bores each having a portion of the forward portion of a respective contact therein, and a rearwardly facing surface adapted to engage the forwardly facing shoulder of each of said contacts, the improvement wherein:

each of said members of said rear insert, includes at the forward end of said member a radially inwardly chamfered surface and, rearwardly adjacent to the chamfered surface, a forwardly facing shoulder engaging the rearwardly facing shoulder of a respective contact; and said forward insert includes a plurality of passages annularly arranged around each of said bores, each of its passages axially aligned with a respective forwardly facing shoulder of the deflectable members of said rear insert, whereby a tool may be inserted into the passages to engage and radially deflect said deflectable members at the end of that passage thereby releasing the contact for removal from the rear of the connector.

2. In combination with an electrical connector having front and rear releasable rear removable contacts, said connector of the type having: a housing; a plurality of contacts, each contact having a rear portion, a forward mating portion, and an enlarged middle portion having a forwardly facing shoulder and a rearwardly facing shoulder, and means for releasably mounting said contacts in said housing including an insert having a plurality of bores each having a portion of a respective contact therein, a plurality of resiliently and radially deflectable members extending forwardly in the direction of said enlarged middle portion of said contacts and a rearwardly facing shoulder in each of said bores adapted to engage the forwardly facing shoulder of a respective contact, the improvement wherein:

each of said members includes at the forward end of said member a radially inwardly chamfered surface and, rearwardly adjacent to the chamfered surface, a forwardly facing shoulder engaging the rearwardly facing shoulder of a respective contact; and a second plurality of passages annularly arranged around each of said bores and extending rearwardly from the front of said insert, each of said passages axially aligned with a respective forwardly facing shoulder of the deflectable members, whereby a tool may be inserted into the passages to engage and radially deflect said deflectable members at the end of that passage thereby releasing the contact for removal from the rear of the connector.

3. In combination with an electrical connector having removable contacts, said connector of the type having: a housing; a plurality of cylindrical contacts, each contact having a rear portion, a forward mating portion, and an enlarged middle portion having a forwardly facing shoulder and a rearwardly facing shoulder; and means for releasably mounting said contacts in said housing including a rear insert having a plurality of bores each having the rear portion of a respective contact therein, a plurality of resiliently and radially deflectable members extending from the forward position of each of said bores, and a forward insert having a plurality of bores each having a portion of the forward portion of a respective contact therein, and a rearwardly facing surface adapted to engage the forwardly facing shoulder of each of said contacts, the improvement wherein:

each of said members of said rear insert, includes at the forward end of said member a radially inwardly chamfered surface and, rearwardly adjacent to the chamfered surface, a forwardly facing shoulder engaging the rearwardly facing shoulder of a respective contact; and said forward insert includes a plurality of passages annularly arranged around each of said bores, each of its passages axially aligned with a respective forwardly facing shoulder of the deflectable members of said rear insert, whereby a tool may be inserted into one of said bores in the rear insert and said plurality of passages around a bore in the front insert to engage and radially deflect said deflectable members thereby releasing the contact for removal from the rear of the connector.

* * * * *